United States Patent [19]

Jeschke

[11] Patent Number: 4,480,542

[45] Date of Patent: Nov. 6, 1984

[54] DEVICE FOR INK PROFILE-DEPENDENT REGULATION OF DAMPENING MEDIUM

[75] Inventor: Willi Jeschke, Heidelberg, Fed. Rep. of Germany

[73] Assignee: Heidelberger Druckmaschinen, Heidelberg, Fed. Rep. of Germany

[21] Appl. No.: 565,144

[22] Filed: Dec. 23, 1983

[51] Int. Cl.[3] ..... B41L 23/04; B41F 7/24; B41F 33/10

[52] U.S. Cl. ..... 101/148; 101/349; 101/DIG. 24

[58] Field of Search ..... 101/148, DIG. 24, DIG. 26, 101/349, 350, 351–353, 364, 365, 366, 207–210

[56] References Cited

U.S. PATENT DOCUMENTS

| | | | |
|---|---|---|---|
| 3,134,326 | 5/1964 | Davis | 101/366 |
| 3,822,643 | 7/1974 | Mikan et al. | 101/148 |

FOREIGN PATENT DOCUMENTS

| | | | |
|---|---|---|---|
| 2944322 | 5/1981 | Fed. Rep. of Germany | 101/DIG. 24 |
| 1438634 | 6/1976 | United Kingdom | 101/148 |

*Primary Examiner*—Clifford D. Crowder

*Attorney, Agent, or Firm*—Herbert L. Lerner; Laurence A. Greenberg

[57] ABSTRACT

A device for ink profile-dependent regulation of dampening medium in an offset printing unit having an inking-dampening unit which, over the width of a type forme, supplies a dampening medium film of substantially uniform thickness to a plate cylinder and to an inking part of the inking-dampening unit includes a hydrophilic measuring roller, measuring means adjacent the measuring roller for determining extent of wetting of an outer cylindrical surface of the measuring roller section-by-section over the width of the measuring roller and for transmitting corresponding signals, means for varying the proportion of dampening medium in the ink film section-by-section, control means for converting the signals from the measuring means into adjustment commands and applying them to the proportion varying means for varying the proportion of dampening solution in the ink film section, the hydrophilic measuring roller being in cooperative engagement with a rubber-covered ink roller, the control means being actuatable in accordance with the signals and through the intermediary of the temperature on the cylindrical surface of the measuring roller for varying the quantity of dampening medium in at least an individual zone of the width of the measuring roller so that the dampening-medium film accepted by the measuring roller from the rubber-covered ink roller is influenced.

12 Claims, 4 Drawing Figures

DEVICE FOR INK PROFILE-DEPENDENT REGULATION OF DAMPENING MEDIUM

The device relates to a device for ink profile-dependent regulation of dampening medium in an offset printing machine having an inking-dampening unit which, over the width of a type forme, supplies a dampening medium film of substantially uniform thickness to a plate cylinder and to an inking part of the inking-dampening unit including a hydrophilic measuring roller, measuring means adjacent the measuring roller for determining extent of wetting of an outer cylindrical surface of the measuring roller section-by-section over the width of the measuring roller and for transmitting corresponding signals, means for varying the proportion of dampening medium in the ink film section-by-section, and control means for converting the signals from the measuring means into adjustment commands and applying them to the proportion varying means for varying the proportion of dampening solution in the ink film section-by-section.

In modern rotary printing presses there is the desire to optimize the ink-water equilibrium in each zone over the width of the plate in order to improve the quality of the printed image as a whole. To this end, in co-pending application Ser. No. 500,316 of Willi Jeschke, filed June, 2, 1983, and assigned to the same corporate assignee as that of the instant application, there are prepared two methods by means of which, as viewed over the width of the press, as uniform an ink-water emulsion as possible is achieved whereby the start-up conditions of the press are also positively influenced. Because it is assumed that each ink roller is also a water-carrying roller and the quantity of water, due to the geometry of the inking unit i.e. due to the position of the individual ink rollers, is dependent upon the subject and upon the local temperature conditions, it has been established that the proportion of dampening medium in the ink film is particularly high at the run-in of the plate in the region of the dampening unit. This is understandable because there is also an especially large amount of dampening medium in this region. Furthermore, however, it has been shown that there is also a high proportion of dampening medium in the ink at the runout of the plate in the region of the last inking roller, as viewed in direction of rotation of the plate cylinder.

This leads to the realization that the regulation of dampening medium in the region of the dampening unit and also on the inking unit rollers which are located after the dampening unit must be partially compensated. It is, therefore, an object of the invention, in addition to the customary zone-wise regulation of dampening medium in the dampening unit, to implement an additional regulation of the quantity of dampening medium contained in the ink in the region of the inking unit with which zone-wise influencing of the quantity of dampening medium is afforded by the use of relatively simple means.

With the foregoing and other objects in view, there is provided, in accordance with the invention, a device for ink profile-dependent regulation of dampening medium in an offset printing unit having an inking-dampening unit which, over the width of a type forme, supplies a dampening medium film of substantially uniform thickness to a plate cylinder and to an inking part of the inking-dampening unit comprising a hydrophilic measuring roller, measuring means adjacent the measuring roller for determining extent of wetting of an outer cylindrical surface of the measuring roller section-by-section over the width of the measuring roller and for transmitting corresponding signals, means for varying the proportion of dampening medium in the ink film section-by-section, control means for converting the signals from the measuring means into adjustment commands and applying them to the proportion varying means for varying the proportion of dampening solution in the ink film section-by-section, the hydrophilic measuring roller being in cooperative engagement with a rubber-covered ink roller, the control means being actuatable in accordance with the signals and through the intermediary of the temperature on the cylindrical surface of the measuring roller for varying the quantity of dampening medium in at least an individual zone of the width of the measuring roller so that the dampening-medium film accepted by the measuring roller from the rubber-covered ink roller is influenced.

This provides the advantage that an excess of dampening medium can be detected for each zone separately and this excess is eliminated in a relatively simple manner. This method is based on the realization that an increase in temperature at the surface of a hydrophilic measuring roller causes greater evaporation of the dampening medium, and thus a reduction in the proportion of dampening medium in the ink.

In accordance with a concomitant feature of the invention, a device for ink profile-dependent regulation of dampening medium in an offset printing unit having an inking-dampening unit which, over the width of a type forme, supplies a dampening medium film of substantially uniform thickness to a plate cylinder and to an inking part of the inking-dampening unit comprising a hydrophilic measuring roller, measuring means adjacent the measuring roller for determining extent of wetting of an outer cylindrical surface of the measuring roller section-by-section over the width of the measuring roller, and for transmitting corresponding signals, means for varying the proportion of dampening medium in the ink film section-by-section, control means for converting the signals from the measuring means into adjustment commands and applying them to the proportion varying means for varying the proportion of dampening solution in the ink film section-by-section, the hydrophilic measuring roller being in cooperative contact with a rubber-covered ink roller bearing the dampening-medium profile and located in vicinity of a last forme roller as viewed in direction of rotation of the plate cylinder, the measuring means being located after the contact location of the measuring roller with the rubber-covered ink roller, as viewed in direction of rotation of the measuring roller, and being formed of sensors for measuring the dampening medium section-by-section and for transmitting the measurement signals additionally to zone-by-zone acting heat sources located after the sensors in the direction of rotation of the measuring roller.

Other features which are considered as characteristic for the invention are set forth in the appended claims.

Although the invention is illustrated and described herein as embodied in a device for regulating dampening medium in accordance with an ink profile in an inking unit of an offset printing machine, it is nevertheless not intended to be limited to the details shown, since various modifications and structural changes may be made therein without departing from the spirit of the invention and within the scope and range of equivalent of the claims.

The construction and method of operation of the invention, however, together with additional objects and advantages thereof will be best understood from the following description of specific embodiments when read in connection with the accompanying drawings, in which.

Figure 1:
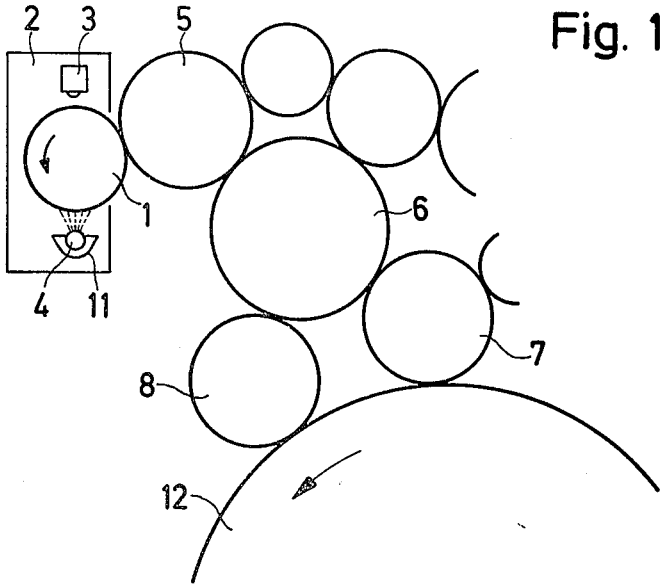
FIG. 1 is a diagrammatic side elevational view of an inking unit according to the invention with an additional roller.

Referring now to the drawing and first, particularly, to FIG. 1 thereof, there is shown an inking unit formed of a hydrophilic measuring roller e.g. a chrome or aluminum roller 1, which is located partly within a housing 2. Assigned to the measuring roller 1 inside the housing 2 are sensors 3 extending over the entire length of the measuring roller 1. This ensures the measurement of the behavior of the ink and of the dampening solution with extreme accuracy in all areas. Furthermore, a heat source 4 is provided parallel to the measuring roller 1 in order to produce the desired changes in temperature at the measuring roller 1. The heat source 4 is connected to the housing 2 by means of bracket 11. Through the intermediary of an ink roller 5, the measuring roller 1 is disposed in contact with a distributor 6. This distributor 6 is also in contact with two forme rollers 7 and 8 which, in turn, roll on the plate cylinder 12 of a printing unit.

Figure 2:
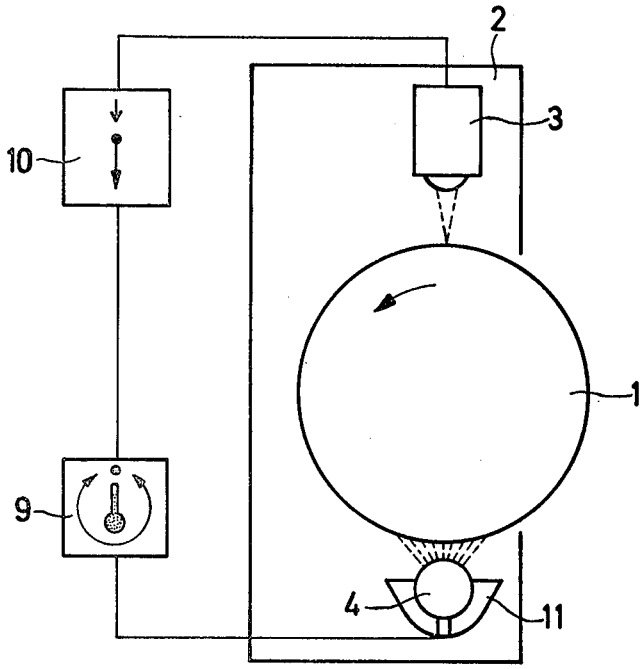
FIG. 2 is a diagrammatic and schematic view of a device for measuring and for changing the temperature at the measuring roller.

As is shown in detail in FIG. 2, the sensors 3 and the heat source 4 are coupled with a control device 10 and a temperature regulator 9. Through signals from the sensors 3, the control device 10 regulates the pulse-like radiation of the heat source 4 by means of a temperature regulator 9. The individual sensors 3 measure the share of fraction of dampening solution in the ink and thus the greasing or scumming, which, in turn, is used to regulate the zone-wise heat influencing.

The dampening solution is regulated even before there can be any scumming at all on the plate cylinder 12 or before the watermark limit is reached. The measuring roller 1 can be assigned to any rubber-covered ink roller, but it is advantageous for it to be in the region of the last forme roller 8.

Figure 3:
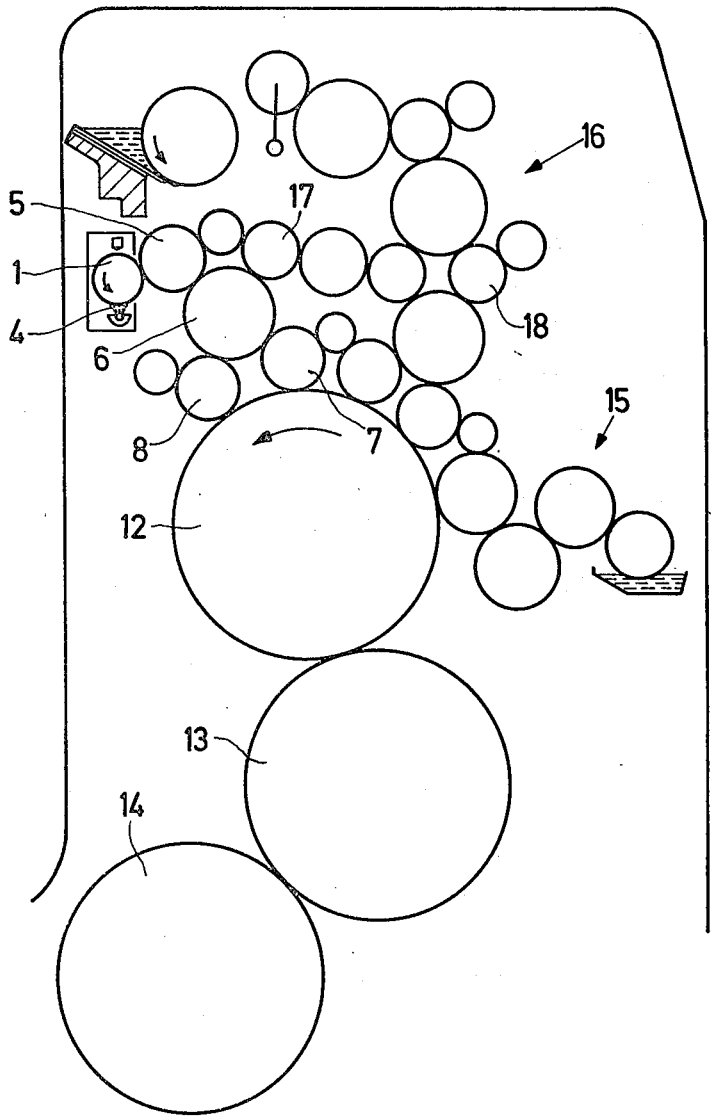
FIG. 3 is a diagrammatic side elevational view of a printing unit incorporating the inking unit of the invention.

A diagrammatic view of a conventional printing unit represented in FIG. 3 shows a rubber-covered or blanket cylinder 13 which is provided between the plate cylinder 12 and an impression cylinder 14. A dampening unit 15 is disposed before or upstream of an inking unit 16, as viewed in direction of rotation of the plate cylinder 12. The measuring roller 1 which, in the illustrated embodiment of FIG. 3, is assigned to the rubber-covered ink roller 5 could also be assigned, for example, to rubber-covered ink roller 17 or 18.

Figure 4:
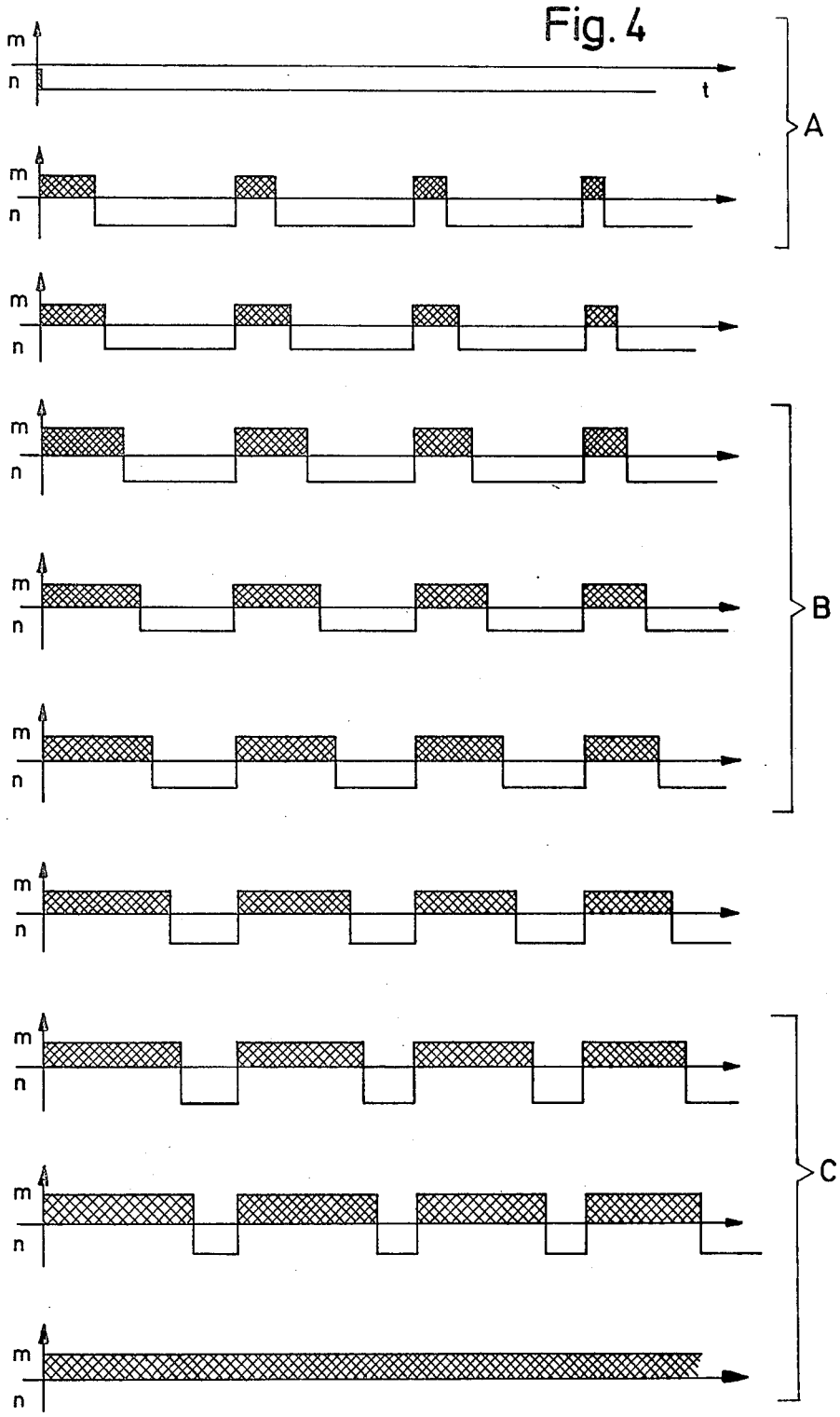
FIG. 4 is a plot diagram showing different shares of fractions of dampening solution on the inking unit rollers.

The idealized behavior of the dampening solution on the measuring roller 1 is shown in FIG. 4. Depending upon the existing amount of water, the time period during which the heat source 4 is switched on is varied zone-by-zone according to the measurement signals from the sensors 3. Because the measuring roller 1 is always slightly warmer than the plate cylinder 12, scumming occurs on the measuring roller 1 before it occurs on the plate cylinder 12. In the different states or conditions shown in FIG. 4, the variable "time" t is plotted in the abscissa and the statuses "m" for heat "on" and "n" for heat "off" are plotted on the ordinates. Region A shows two statuses in which there is too little water on the measuring roller 1 in the individual zones. Accordingly, the heat source 4 is either not switched on at all or only briefly. At the same time, the supply of dampening solution is increased overall and, as an alternative, the cooling of the inking unit is also boosted. Region B shows the normal status for the supply of dampening solution, depending upon the subject, upon the heating of the press and upon other factors. Once again, the three states or conditions of region B differ with regard to the switched-on time of the heat source 4 which may differ from zone to zone. In this case, too, there is scumming on the chrome roller 1 when the heat is switched on. Due to the heating of the printing press, which occurs in the interim, the equilibrium between ink and dampening solution is regulated solely by the switched-on time of the heat source 4. In region C, there is too much dampening water on the chrome roller 1, with the result that the switched-on time of the heat sources 4 is considerably lengthened. At the same time, however, the supply of dampening solution as a whole is also reduced in order to return the status or condition on the chrome roller 1 into the region B. The thermal influencing in the region B e.g. when using special printing inks, can also be controlled in a superimposed or superordinate manner and can thus be influenced.

This embodiment is in no way the only one possible. The supply of heat can also be regulated by varying the intensity of the radiation by modulating the frequency or the pulse width. It would, for example, also be conceivable to implement zone-wise cooling in order to maintain the ink/dampening medium balance. Furthermore, it would be possible to provide this device at another location on the inking unit.

The foregoing is a description corresponding in substance to German Application P 32 47 761.9, dated Dec. 23, 1982, the International priority of which is being claimed for the instant application, and which is hereby made part of this application. Any material discrepancies between the foregoing specification and the aforementioned corresponding German application are to be resolved in favor of the latter.

I claim:

1. Device for ink profile-dependent regulation of dampening medium in an offset printing unit having an inking-dampening unit which, over the width of a type forme, supplies a dampening medium film of substantially uniform thickness to a plate cylinder and to an inking part of the inking-dampening unit comprising a hydrophilic measuring roller, measuring means adjacent said measuring roller for determining extent of wetting of an outer cylindrical surface of said measuring roller section-by-section over the width of said measuring roller and for transmitting corresponding signals, means for varying the proportion of dampening medium in the ink film section-by-section, control means for converting the signals from said measuring means into adjustment commands and applying them to said proportion varying means for varying the proportion of dampening solution in the ink film section-by-section, said hydrophilic measuring roller being in cooperative engagement with a rubber-covered ink roller, said control means being actuatable in accordance with the signals and through the intermediary of the temperature on the cylindrical surface of said measuring roller for varying the quantity of dampening medium in at least an individual zone of the width of said measuring roller so that the dampening-medium film accepted by said measuring roller from said rubber-covered ink roller is influenced.

2. Device according to claim 1 including temperature-regulating means connected to said hydrophilic measuring roller.

3. Device according to claim 2 wherein said temperature-regulating means are a cooling device.

4. Device according to claim 1 wherein said rubber-covered ink roller cooperatively engaging said hydrophilic measuring roller is in contact with a distributor roller.

5. Device according to claim 1 wherein said rubber-covered ink roller cooperatively engaging said hydrophilic measuring roller is in contact with a distributor roller feeding a last forme roller, as viewed in direction of rotation of the plate cylinder.

6. Device for ink profile-dependent regulation of dampening medium in an offset printing unit having an inking-dampening unit which, over the width of a type forme, supplies a dampening medium film of substantially uniform thickness to a plate cylinder and to an inking part of the inking-dampening unit comprising a hydrophilic measuring roller, measuring means adjacent said measuring roller for determining extent of wetting of an outer cylindrical surface of said measuring roller section-by-section over the width of said measuring roller and for transmitting corresponding signals, means for varying the proportion of dampening medium in the ink film section-by-section, control means for converting the signals from said measuring means into adjustment commands and applying them to said proportion varying means for varying the proportion of dampening solution in the ink film section-by-section, said hydrophilic measuring roller being in cooperative contact with a rubber-covered ink roller bearing the dampening-medium profile and located in vicinity of a last forme roller as viewed in direction of rotation of the plate cylinder, the measuring means being located after the contact location of said measuring roller with said rubber-covered ink roller, as viewed in direction of rotation of said measuring roller, and being formed of sensors for measuring the dampening medium section-by-section and for transmitting the measurement signals additionally to zone-by-zone acting heat sources located after said sensors in said direction of rotation of said measuring roller.

7. Device according to claim 6 including temperature-regulating means connected to said hydrophilic measuring roller.

8. Device according to claim 7 wherein said temperature-regulating means are a cooling device.

9. Device according to claim 6 wherein said rubber-covered ink roller cooperatively engaging said hydrophilic measuring roller, is in contact with a distributor roller.

10. Device according to claim 6 wherein said rubber-covered ink roller cooperatively engaging said hydrophilic measuring roller is in contact with a distributor roller feeding said last forme roller.

11. Device according to claim 6 wherein said sensors of said measuring means, in addition to influencing said heat sources, influence the quantity of dampening medium supplied from the dampening unit for selectively measuring and decreasing the extent of wetting on said measuring roller.

12. Device according to claim 6 wherein said heat sources are switchable on for pulse-like time periods, said sensors through the intermediary of said control means and timing means being effective for selectively lengthening and shortening said pulse-like on-time of said heat sources.

* * * * *